United States Patent [19]

Miljkovic

[11] Patent Number: 4,786,746

[45] Date of Patent: Nov. 22, 1988

[54] COPPER ELECTROPLATING SOLUTIONS AND METHODS OF MAKING AND USING THEM

[75] Inventor: Momcilo Miljkovic, Hummelstown, Pa.

[73] Assignee: Pennsylvania Research Corporation, University Pk., Pa.

[21] Appl. No.: 98,254

[22] Filed: Sep. 18, 1987

[51] Int. Cl.[4] ..... C07C 148/00

[52] U.S. Cl. ..... 560/302

[58] Field of Search ..... 560/302

[56] References Cited

U.S. PATENT DOCUMENTS

| | | | |
|---|---|---|---|
| 2,579,531 | 12/1951 | Zadra | 204/109 |
| 2,677,653 | 5/1954 | Chester et al. | 204/52 |
| 2,758,076 | 8/1956 | Passal | 204/52.1 |
| 2,798,040 | 7/1957 | Pye et al. | 204/108 |
| 2,825,684 | 3/1958 | Wernlund | 204/52 |
| 2,837,472 | 6/1958 | Gundel et al. | 204/49 |
| 2,888,390 | 5/1959 | Lapee | 204/108 |
| 2,954,331 | 9/1960 | Abbott | 204/52 |
| 3,203,878 | 8/1965 | Willmund et al. | 204/52 |
| 3,287,236 | 11/1966 | Brugger | 204/52 |
| 3,328,273 | 6/1967 | Creutz et al. | 204/52 |
| 3,414,493 | 12/1968 | Nobel et al. | 204/52 |
| 3,542,655 | 11/1970 | Kardos et al. | 204/52 |
| 3,682,788 | 8/1972 | Kardos et al. | 204/52 R |
| 3,743,584 | 7/1973 | Todt et al. | 204/52 R |
| 3,748,237 | 7/1973 | Creutz | 204/55 R |
| 3,764,660 | 7/1972 | Lyde | 204/52 R |
| 3,770,598 | 11/1973 | Creutz | 204/52 R |
| 3,781,296 | 12/1973 | Greco et al. | 546/261 |
| 3,804,729 | 4/1974 | Kardos et al. | 204/52 R |
| 3,884,884 | 5/1975 | Scoggins et al. | 528/360 |
| 3,904,686 | 9/1975 | Arnold et al. | 564/75 |
| 3,919,179 | 11/1976 | Maxey | 525/349 |
| 3,928,365 | 12/1975 | Greco et al. | 546/261 |
| 3,932,346 | 1/1976 | Pasternack et al. | 523/459 |
| 3,956,235 | 5/1976 | Pasternack et al. | 523/459 |
| 4,038,161 | 7/1977 | Eckles et al. | 204/52 R |
| 4,110,176 | 8/1978 | Creutz et al. | 204/52 R |
| 4,128,539 | 12/1978 | Onizawa | 525/187 |
| 4,134,803 | 1/1979 | Eckles et al. | 204/52 R |
| 4,146,689 | 3/1979 | Onizawa | 526/36 |
| 4,165,416 | 8/1979 | Matoba et al. | 525/346 |
| 4,177,337 | 12/1979 | Onizawa | 525/331 |
| 4,181,582 | 1/1980 | Dahms | 204/52 R |
| 4,272,335 | 6/1981 | Combs | 204/52 R |
| 4,278,510 | 7/1981 | Chien et al. | 204/104 R |
| 4,289,861 | 9/1981 | Onizawa | 525/346 |
| 4,347,108 | 8/1982 | Willis | 204/52 R |
| 4,376,685 | 3/1983 | Watson | 204/52 R |
| 4,384,930 | 5/1983 | Eckles | 204/435 |
| 4,399,075 | 8/1983 | Yoshida et al. | 558/414 |
| 4,490,220 | 12/1984 | Houman | 204/52 R |
| 4,502,927 | 3/1985 | Barclay et al. | 204/31 |
| 4,514,442 | 4/1985 | Crepeau | 427/140 |
| 4,555,315 | 11/1985 | Barbieri et al. | 204/52 R |
| 4,587,140 | 5/1986 | Johnson et al. | 427/372.2 |
| 4,601,847 | 7/1986 | Barber, Jr. | 252/312 |
| 4,663,237 | 5/1987 | Johnson et al. | 428/500 |
| 4,666,785 | 5/1987 | Crepeau | 428/521 |

OTHER PUBLICATIONS

Bulletin of Howard Hall International, "Electroplating Chemicals", Feb. 1985.

*Primary Examiner*—Robert A. Wax

[57] ABSTRACT

A method of preparing a compound useful as a brightener in aqueous copper electroplating solutions comprising reacting a compound of the following formula:

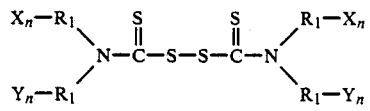

with a compound of the formula:

$HS—R_2—Z_n$ wherein:

$R_1$ and $R_2$ each is an alkyl containing from 2 to 8 carbon atoms, an aryl, an alkylaryl, an arylalkyl or a heterocyclic group containing at least one nitrogen atom in its ring;

X, Y and Z each is hydrogen or a water-solubilizing group; and n is an integer of from 1 to 4; provided that:

when $R_1$ is a heterocyclic group, X, Y and Z are hydrogen and $R_2$ is an alkyl containing from 2 to 8 carbon atoms, an aryl, an alkylaryl or an arylalkyl;

when $R_2$ is a heterocyclic group, X, Y and Z are hydrogen and $R_1$ is an alkyl containing from 2 to 8 carbon atoms, an aryl, an alkylaryl or an arylalkyl;

when X or Y is a water-solubilizing group, $R_2$ is an alkyl containing from 2 to 8 carbon atoms, an aryl, an alkylaryl or an arylalkyl and Z is hydrogen;

when Z is a water-solubilizing group, $R_1$ is an alkyl containing from 2 to 8 carbon atoms, an aryl, an alkylaryl or an arylalkyl and X and Y are hydrogen; and when X and Y are both water-solubilizing groups they may be the same or different water-solubilizing groups.

The invention also comprises aqueous acidic copper electroplating solutions containing the brightener and methods of making and using such solutions.

7 Claims, No Drawings

COPPER ELECTROPLATING SOLUTIONS AND METHODS OF MAKING AND USING THEM

BACKGROUND OF THE INVENTION

This invention relates to the field of electrodeposition of copper from aqueous solutions. In particular, the invention is concerned with an aqueous solution for the electrodeposition of copper containing additives which provide bright and leveled copper deposits, with a method for making this solution, with a method for making the additives used in the solution and with a method for electrodepositing copper employing this solution.

A large number of agents are known in the art for use, alone or in combination, in electroplating solutions to improve the quality of the electrodeposit of copper in terms of brightness, surface smoothness, hardening, leveling and to increase the lower limiting current density of deposition. A "bright" electrodeposit is an electrodeposit which has a uniform highly reflective surface gloss over substantially all of its surface, and brighteners are additives which when added to a copper electroplating solution improve the brightness of the electrodeposit. The term "leveled" denotes a copper deposit whose surface is smoother than that of its substrate. Thus, the ability of a plating bath to produce deposits relatively thicker in small recesses and relatively thinner on small protrusions thereby decreasing the depth of surface irregularities is known as "leveling." For example, a copper plating bath with satisfactory leveling ability can be utilized to reduce or eliminate the effect of microscopic cracks or scratches on the surfaces of the articles being plated.

BRIEF DESCRIPTION OF THE INVENTION

According to the invention, there is provided a method of preparing a compound useful as a brightener in aqueous copper electroplating solutions comprising reacting a compound of the following formula:

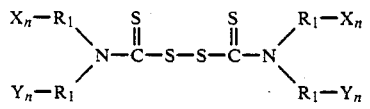

with a compound of the formula:

$$HS-R_2-Z_n$$

wherein:

$R_1$ and $R_2$ each is an alkyl containing from 2 to 8 carbon atoms, an aryl, an alkylaryl, an arylalkyl or a heterocyclic group containing at least one nitrogen atom in its ring;

X, Y and Z each is hydrogen or a water-solubilizing group; and n is an integer of from 1 to 4; provided that:

when $R_1$ is a heterocyclic group, X, Y and Z are hydrogen and $R_2$ is an alkyl containing from 2 to 8 carbon atoms, an aryl, an alkylaryl or an arylalkyl;

when $R_2$ is a heterocyclic group, X, Y and Z are hydrogen and $R_1$ is an alkyl containing from 2 to 8 carbon atoms, an aryl, an alkylaryl or an arylalkyl;

when X or Y is a water-solubilizing group, $R_2$ is an alkyl containing from 2 to 8 carbon atoms, an aryl, an alkylaryl or an arylalkyl and Z is hydrogen;

when Z is a water-solubilizing group, $R_1$ is an alkyl containing from 2 to 8 carbon atoms, an aryl, an alkylaryl or an arylalkyl and X and Y are hydrogen; and when X and Y are both water-solubilizing groups they may be the same or different water-solubilizing groups; and allowing the reaction to reach final equilibrium so that a reaction mixture containing the brightener is formed. The brightener has the following formula:

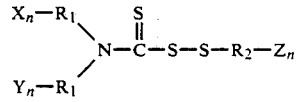

wherein $R_1$, $R_2$, X, Y, Z and n are as defined above.

The invention also comprises electroplating solutions containing the brightener and methods of making and using such solutions. An electroplating solution according to the invention can be prepared by adding to an aqueous solution comprising a water-soluble copper salt and a free acid, a portion of the reaction mixture containing the brightener sufficient to give bright copper deposits. Alternatively, the brightener may be separated from the reaction mixture and used in pure form to prepare the aqueous copper electroplating solutions of the invention. Other components conventional in such solutions may also be included in the electroplating solutions of the invention.

The solutions of the invention are then used to electroplate articles with copper by contacting the article to be plated with them. The inclusion of the brighteners (purified or as part of the reaction mixture) in aqueous copper electroplating solutions gives bright deposits of copper over a wide range of current densities.

DETAILED DESCRIPTION OF THE PREFERRED EMBODIMENTS

The brighteners for use in the aqueous copper electroplating solutions of the invention are prepared by reacting a compound of the formula:

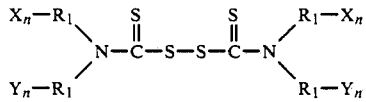

I with a compound of the formula:

$$HS-R_2-Z_n \qquad \text{II}$$

wherein:

$R_1$ and $R_2$ each is an alkyl containing from 2 to 8 carbon atoms, an aryl, an alkylaryl, an arylalkyl or a heterocyclic group containing at least one nitrogen atom in its ring;

X, Y and Z each is hydrogen or a water-solubilizing group; and n is an integer of from 1 to 4; provided that:

when $R_1$ is a heterocyclic group, X, Y and Z are hydrogen and $R_2$ is an alkyl containing from 2 to 8 carbon atoms, an aryl, an alkylaryl or an arylalkyl;

when $R_2$ is a heterocyclic group, X, Y and Z are hydrogen and $R_1$ is an alkyl containing from 2 to 8 carbon atoms, an aryl, an alkylaryl or an arylalkyl;

when X or Y is a water-solubilizing group, $R_2$ is an alkyl containing from 2 to 8 carbon atoms, an aryl, and alkylaryl or an arylalkyl and Z is hydrogen:

when Z is a water-solubilizing group, $R_1$ is an alkyl containing from 2 to 8 carbon atoms, an aryl, an alkylaryl or an arylalkyl and X and Y are hydrogen; and when X and Y are both water-solubilizing groups, they may be the same or different water-solubilizing groups.

Equimolar amounts of the reactants are used. The reaction can be carried out in any solvent which does not react with any of the reactants or reaction products and in which the reactants and reaction products are soluble. Alcohols such as methanol and ethanol are suitable solvents. The reactants are dissolved in the solvent, and the solution is heated at reflux temperature until the reaction reaches final equilibrium. The time it takes for the reaction to reach final equilibrium will vary depending on the reactants, but, generally, refluxing for from about 0.5 to about 5 or 6 hours is sufficient.

The products of this reaction are:

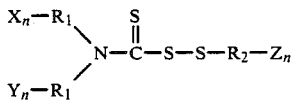

III and

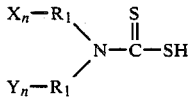

IV wherein $R_1$, $R_2$, X, Y, Z and n are as defined above.

The reaction is an equilibrium, but the production of compounds III and IV is heavily favored. Thus, the final reaction mixture will contain predominantly compounds III and IV, with lesser amounts of compounds I and II present.

Compound I is a brightener, compound II is electrochemically inactive, compound III is a brightener and compound IV is a leveler. Thus, the complete reaction mixture can be used as is in the aqueous copper electroplating solutions of the invention. A portion of the complete reaction mixture sufficient to give bright deposits of copper is simply mixed with the other ingredients of the electroplating solution.

However, better results are obtained if a portion of compound IV is removed from the reaction mixture before it is used in the electroplating solutions of the invention. The separation of compound IV from the reaction mixture can be accomplished by chromatographic means.

Compound III can, of course, be separated from all of the other compounds in the reaction mixture, and the use of purified compound III is the most preferred mode of practicing the invention. The purification of compound III can also be accomplished by chromatographic means.

Compound III has a hydrophobic portion and a hydrophilic portion. The hydrophobic portion makes the compound amenable to easy removal from the copper electroplating solution with activated charcoal.

The hydrophilic portion is necessary to impart water-solubility to compound III so that it can be used in the aqueous copper electroplating solutions of the invention. Thus, X, Y and Z may be any substituent which will render compound III soluble in aqueous acidic copper electroplating solutions. Such water-solubilizing substituents include hydroxy, nitro, sulfonic acid, carboxylic acid and alkali metal sulfonates and carboxylates. Alternatively, the protonation of the nitrogens of the heterocyclic groups when they are present will render compound III water-soluble. Indeed, the use of compounds wherein $R_1$ or $R_2$ is a heterocyclic group containing at least one nitrogen in its ring is preferred because such compounds, while water-soluble in the acidic electroplating solutions of the invention, are also uncharged. Uncharged organic molecules are much easier to purify than charged organic molecules.

Other preferred brighteners for use in the electroplating solutions of the invention are those in which $R_1$ is an aryl group, and most preferably wherein $R_1$ is an aryl group substituted with a water-solubilizing group. Such compounds are more stable in aqueous solutions at low pH than those wherein $R_1$ is an alkyl and, consequently, electroplating solutions containing them last longer. In particular, it is possible to electroplate about 5 to 6 times as many Hull cell panels with an electroplating solution containing compound III wherein $R_1$ is phenyl as compared to an electroplating solution containing compound III wherein $R_1$ is ethyl. Further, compunds containing aryls substituted with water-solubilizing groups are more stable than unsubstituted aryls. Finally, compounds of formula III wherein $R_1$ is an aryl group (substituted and unsubstituted) are chromophores which are amenable to detection by ultraviolet absorbance because of the presence of the two aromatic rings. Thus, it is possible to monitor the concentration of such diaryl compounds in the electroplating solution.

The invention also includes aqueous copper electroplating solutions comprising compound III. The base electroplating solution to which compound III (either purified or as part of the reaction mixture) is added is conventional and well known. The two essential constituents are a water-soluble copper salt, such as copper sulfate, and an acid, such as sulfuric acid. A source of chloride ions is also often included. In general an aqueous solution of the following composition is used: between about 50 to about 250 g/l of copper sulfate, between about 30 to about 250 g/l of sulfuric acid and between about 0.05 to about 0.25 g/l of sodium chloride or from about 0.05 to about 0.40 ml/l of hydrochloric acid.

To ensure a uniform copper deposit, the aqueous copper electroplating solutions should also contain a wetting agent. The nature of the wetting agent is not critical, but preferred wetting agents are oxyalkylene polymers having a molecular weight of 500 to 10,000. The polyalkylene glycols, such as polyethylene glycol and polypropylene glycol, are the preferred oxyalkylene polymers for use in the electroplating solutions of the invention, and a mixture of polyethylene glycol and polypropylene glycol is most preferred. Generally, the polyoxyalkylene is used at about 0.05 to about 8.0 g/l in the aqueous copper electroplating solutions.

Amides may also desirably be added to electroplating solutions of the invention. Examples of suitable amides are those amides represented by the following formula:

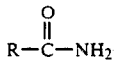

wherein R is a lower alkylene radical having from 2 to 4 carbon atoms, an aromatic radical or a hydrogen atom. Acrylamide is preferred. The amides are generally used at a concentration of from about 0.0001 to about 2.0 g/l in the electroplating solutions.

If needed, a leveler may also be added to the electroplating solutions of the invention. The use of O-ethylxanthic acid, potassium salt, as the leveler is preferred.

Additional compatible brighteners, grain refiners, leveling agents or other additives known in the art can be added to the electroplating solutions of the invention.

EXAMPLE 1

To a 50 ml flask, 296 mg. tetraethylthiuram disulfide, 178 mg. 3-mercaptopropanesulfonic acid sodium salt and 25 ml of methanol were added. The resultant solution was heated at reflux for 2 hours. The reaction solution had a pale yellow color and a characteristic odor. After two hours of reflux, the solution was diluted with 80 ml of water causing a white crystalline material to separate from the solution. This crystalline material was removed by filtration, and the resulting clear solution contained the brightener (sodium 1-sulfopropyl) N N-diethyltrithiopercarbamate.

EXAMPLE 2

To a 50 ml flask, 488 mg. tetraphenylthiuram disulfide, 178 mg. 3-mercaptopropanesulfonic acid sodium salt and 25 ml of methanol are added. The resultant solution is heated at reflux for 2 hours. After two hours of reflux, the solution is diluted with 80 ml of water which causes a small amount of a white crystalline material to separte from the solution. This crystalline material is removed by filtration. The resulting clear solution contains the brightener (sodium 1-sulfopropyl) N,N-diphenyltrithiopercarbamate.

EXAMPLE 3

An aqueous copper electroplting solution was prepared containing:

| Component | Quantity |
|---|---|
| The clear solution containing 1-sulfopropyl) N,N—diethyltrithiopercarbamate prepared in Example 1 | 0.8 ml (sodium |
| 0.01 M solution of O—ethylxanthic acid, potassium salt, prepared as described below | 0.4 ml |
| Solution of polyethylene glycol and polypropylene glycol prepared as described below | 11.0 ml |
| 0.01 M solution of acrylamide prepared as described below | 1.0 ml |
| Copper sulfate ($CuSO_4 \cdot 5\ H_2O$) | 216 grams |
| Sulfuric acid | 31 grams |
| HCl | 0.15 ml |

-continued

| Component | Quantity |
|---|---|
| Deionized water (18 megohm) | Enough to make the final volume 1.0 liter |

The O-ethylxanthic acid, potassium salt, was purchased from Aldrich Chemical Company, Milwaukee, Wisconsin (Catalog No. 25477-0). The solution of O-ethylxantic acid potassium salt, used in the electroplating solution was made by recrystallizing the O-ethylxanthic acid from ethanol and dissolving 1.60 grams of the recrystallized O-ethylxanthic acid in 1000 ml of deionized water, 18 megohm.

The polyethylene glycol (Carbowax) (average molecular weight 8000) and polypropylene glycol (average molecular weight 425) were also purchased from Aldrich Chemical Co. (Catalog Nos. 20245-2 and 20230-4, respectively). To a 4 liter flask, 1438 grams of the polyethylene glycol was added to 2000 ml of deionized water, 18 megohm, and stirred at room temperature until it dissolved (approximately 15 hours). Next 287 grams of polypropylene glycol was added, and stirring at room temperature was continued until it dissolved. After all of the solids were dissolved, deionized water was added to bring the solution to a 4 liter volume. The ratio of polyethylene glycol:polypropylene glycol was 5:1.

Acrylamide (electrophoresis grade, gold label) was also purchased from Aldrich Chemical Co. (Catalog No. 14866-0). To 1000 ml of deionized water, 18 megohm, 0.71 grams of the acrylamide was added and stirred to make the 0.01M solution.

This aqueous electroplating solution was used to electrodeposit copper using a standard 267 ml Hull Cell. A brass panel which had been given a standard scratch with 0/4 emery paper was used as the cathode. The current employed was 2 amperes for 10 minutes which gave a range of current densities of from about 1.0 amps/sq. ft. to about 300 amp/sq. ft. across the cathode. All experiments were run at room temperature with air agitation. The electroplating solution provided a bright, level, porosity free copper electroplate on the Hull Cell panels, and the copper deposit was bright over a wide range of current densities.

EXAMPLE 4

An aqueous copper electroplating solution is prepared as described in Example 3, except that the clear solution containing (sodium 1-sulfopropyl) N,N-diphenyltrithiopercarbamate prepared in Example 2 is used in place of the clear solution containing (sodium 1-sulfopropyl) N,N-diethyltrithiopercarbamate prepared in Example 1.

This aqueous electroplating solution is used to electrodeposit copper on Hull Cell panels as described in Example 3. It provides a bright, level, porosity free copper electroplate on the Hull Cell panels, and the copper deposit is bright over a wide range of current densities. Also, it is possible to plate 5–6 times as many contacts with this electroplating solution as with the electroplating solution of Example 3.

I claim:

1. A method of preparing a compound of the formula:

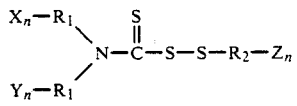

wherein:

$R_1$ and $R_2$ each is an alkyl containing from 2 to 8 carbon atoms, an aryl, an alkylaryl, an arylalkyl or a heterocyclic group containing at least one nitrogen atom in its ring;

X, Y and Z each is hydrogen or a water-solubilizing group; and n is an integer of from 1 to 4; provided that:

when $R_1$ is a heterocyclic group, X, Y and Z are hydrogen and $R_2$ is an alkyl containing from 2 to 8 carbon atoms, an aryl, an alkylaryl or an arylalkyl;

when $R_2$ is a heterocyclic group, X, Y and Z are hydrogen and $R_1$ is an alkyl containing from 2 to 8 carbon atoms, an aryl, an alkylaryl or an arylalkyl;

when X or Y is a water-solubilizing group, R is an alkyl containing from 2 to 8 carbon atoms, an aryl, an alkylaryl or an arylalkyl and Z is hydrogen;

when Z is a water-solubilizing group, $R_1$ is an alkyl containing from 2 to 8 carbon atoms, an aryl, an alkylaryl or an arylalkyl and X and Y are hydrogen; and when X and Y are both water-solubilizing groups, they may be the same or different water-solubilizing groups;

the method comprising reacting a compound of the following formula:

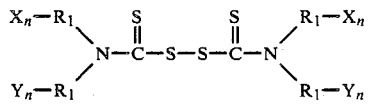

with a compound of the formula:

$HS—R_2—Z_n$ wherein $R_1$, $R_2$, X, Y, Z and n are as defined above.

2. The method of claim 1 wherein $R_1$ is an aryl.

3. The method of claim 2 wherein $R_1$ is phenyl.

4. The method of claim 3 wherein X and Y are hydrogen, $R_2$ is propyl and Z is $SO_3Na$.

5. The method of claim 1 wherein $R_1$ is pyridine or pyrimidine.

6. A method of preparing a compound useful as a brightener in aqueous copper electroplating solutions comprising reacting a compound of the following formula:

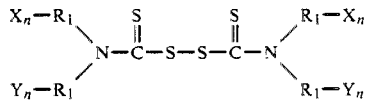

with a compound of the formula:

$HS—R_2—Z_n$ wherein:

$R_1$ and $R_2$ each is an alkyl containing from 2 to 8 carbon atoms, an aryl, an alkylaryl, an arylalkyl or a heterocyclic group containing at least one nitrogen atom in its ring;

X, Y and Z each is hydrogen or a water-solubilizing group; and n is an integer of from 1 to 4; provided that:

when $R_1$ is a heterocyclic group, X, Y and Z are hydrogen and $R_2$ is an alkyl containing from 2 to 8 carbon atoms, an aryl, an alkylaryl or an arylalkyl;

when $R_2$ is a heterocyclic group, X, Y and Z are hydrogen and $R_1$ is an alkyl containing from 2 to 8 carbon atoms, an aryl, an alkylaryl or an arylalkyl;

when X or Y is a water-solubilizing group, $R_2$ is an alkyl containing from 2 to 8 carbon atoms, an aryl, an alkylaryl or an arylalkyl and Z is hydrogen;

when Z is a water-solubilizing group, $R_1$ is an alkyl containing from 2 to 8 carbon atoms, an aryl, an alkylaryl or an arylalkyl and X and Y are hydrogen; and when X and Y are both water-solubilizing groups, they may be the same or different water-solubilizing groups; and allowing the reaction to reach final equilibrium so that a reaction mixture containing the brightener is formed.

7. The method of claim 6 further comprising the step of separating the brightener from the other components of the reaction mixture.

* * * * *